US007021375B2

(12) United States Patent
Ringgenberg et al.

(10) Patent No.: US 7,021,375 B2
(45) Date of Patent: Apr. 4, 2006

(54) METHODS OF DOWNHOLE TESTING SUBTERRANEAN FORMATIONS AND ASSOCIATED APPARATUS THEREFOR

(75) Inventors: Paul David Ringgenberg, Carrollton, TX (US); Mark Anton Proett, Missouri City, TX (US); Michael T. Pelletier, Houston, TX (US); Michael L. Hinz, Houston, TX (US); Gregory N. Gilbert, Missouri City, TX (US); Harold Wayne Nivens, Runaway Bay, TX (US); Mehdi Azari, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/762,835

(22) Filed: Jan. 22, 2004

(65) Prior Publication Data

US 2004/0163803 A1 Aug. 26, 2004

Related U.S. Application Data

(60) Division of application No. 10/270,424, filed on Oct. 11, 2002, now Pat. No. 6,729,398, which is a continuation of application No. 09/971,205, filed on Oct. 4, 2001, now Pat. No. 6,527,052, which is a division of application No. 09/378,124, filed on Aug. 19, 1999, now Pat. No. 6,325,146.

(60) Provisional application No. 60/127,106, filed on Mar. 31, 1999.

(51) Int. Cl.
*E21B 49/00* (2006.01)

(52) U.S. Cl. ..... 166/250.17; 166/264; 166/186

(58) Field of Classification Search ..... 166/264, 166/250.17, 113, 169, 297, 186
See application file for complete search history.

(56) References Cited

U.S. PATENT DOCUMENTS

| | | | | |
|---|---|---|---|---|
| 1,896,492 | A * | 2/1933 | Macready | 166/264 |
| 2,169,559 | A | 8/1939 | Halliburton | |
| 2,945,952 | A | 7/1960 | Bourne et al. | |

(Continued)

FOREIGN PATENT DOCUMENTS

| | | | |
|---|---|---|---|
| EP | 0 699 819 | A2 | 3/1996 |

(Continued)

OTHER PUBLICATIONS

Search Report for U.K. Application No.: GB 0030648.0.

(Continued)

*Primary Examiner*—David Bagnell
*Assistant Examiner*—Giovanna M Collins
(74) *Attorney, Agent, or Firm*—Marlin R. Smith

(57) ABSTRACT

Methods and apparatus are provided which permit well testing operations to be performed downhole in a subterranean well. In various described methods, fluids flowed from a formation during a test may be disposed of downhole by injecting the fluids into the formation from which they were produced, or by injecting the fluids into another formation. In several of the embodiments of the invention, apparatus utilized in the methods permit convenient retrieval of samples of the formation fluids and provide enhanced data acquisition for monitoring of the test and for evaluation of the formation fluids.

34 Claims, 6 Drawing Sheets

U.S. PATENT DOCUMENTS

| | | | | | |
|---|---|---|---|---|---|
| 3,152,639 | A | * | 10/1964 | Pearcy | 166/264 |
| 3,437,138 | A | | 4/1969 | Scott | |
| 3,705,626 | A | | 12/1972 | Glenn, Jr. et al. | |
| 3,923,099 | A | | 12/1975 | Brandon | |
| 4,006,630 | A | | 2/1977 | Cathriner | |
| 4,043,129 | A | | 8/1977 | McCabe et al. | |
| 4,112,745 | A | | 9/1978 | McCabe et al. | |
| 4,210,025 | A | | 7/1980 | Bimond et al. | |
| 4,573,532 | A | * | 3/1986 | Blake | 166/264 |
| 4,662,391 | A | * | 5/1987 | Tolley | 137/393 |
| 4,705,114 | A | | 11/1987 | Schroeder et al. | |
| RE32,755 | E | | 9/1988 | Vans | |
| 4,787,447 | A | | 11/1988 | Christensen | |
| 4,856,585 | A | | 8/1989 | White et al. | |
| 4,878,538 | A | | 11/1989 | Christensen | |
| 4,883,123 | A | | 11/1989 | Zunkel et al. | |
| 4,915,168 | A | | 4/1990 | Upchurch | |
| 5,335,732 | A | | 8/1994 | McIntyre | |
| 5,337,821 | A | | 8/1994 | Peterson | |
| 5,368,100 | A | * | 11/1994 | Lewandowski et al. | 166/264 |
| 5,456,322 | A | | 10/1995 | Tucker et al. | |
| 5,484,018 | A | | 1/1996 | Cavender et al. | |
| 5,490,564 | A | | 2/1996 | Schultz et al. | |
| 5,497,835 | A | | 3/1996 | Stuebinger et al. | |
| 5,540,280 | A | | 7/1996 | Schultz et al. | |
| 5,590,715 | A | | 1/1997 | Amerman | |
| 5,671,811 | A | | 9/1997 | Head | |
| 5,687,791 | A | * | 11/1997 | Beck et al. | 166/250.07 |
| 5,725,059 | A | | 3/1998 | Kuckes et al. | |
| 5,799,733 | A | * | 9/1998 | Ringgenberg et al. | 166/264 |
| 5,803,178 | A | | 9/1998 | Cain | |
| 5,934,374 | A | * | 8/1999 | Hrametz et al. | 166/264 |
| 6,047,781 | A | | 4/2000 | Scott et al. | |
| 6,085,851 | A | | 7/2000 | Scott et al. | |
| 6,173,772 | B1 | * | 1/2001 | Vaynshteyn | 166/250.15 |
| 6,281,489 | B1 | | 8/2001 | Tubel et al. | |
| 6,325,146 | B1 | | 12/2001 | Ringgenberg et al. | |
| 6,325,184 | B1 | | 12/2001 | Lujan | |
| 6,446,719 | B1 | | 9/2002 | Ringgenberg et al. | |
| 6,446,720 | B1 | | 9/2002 | Ringgenberg et al. | |

FOREIGN PATENT DOCUMENTS

| | | | |
|---|---|---|---|
| EP | 0 781 893 | A2 | 7/1997 |
| EP | 0 699 819 | A3 | 12/1997 |
| GB | 2172631 | A | 9/1986 |
| GB | 2221486 | A | 2/1990 |
| WO | WO 00/58604 | A1 | 10/2000 |

OTHER PUBLICATIONS

Search Report for European Application No.: EP 00 30 1471.

Gatlin, C., Petroleum Engineering—Drilling and well Completions, Prentice Hall, 1960, p. 254.

Schultz, Roger L., Halliburton Reservoir Services PTS Tool Systems and Fast Test Technique, Undated.

Operating Instructions 2-3/8 in. and 2-7/8 in. Omega Plug Catcher, Dated Jul. 15, 1981.

Latch-Down Plugs, Dated Jan. 31, 1981.

Cementing Plug Latch Down, Dated Jul. 15, 1981.

Office Action for U.S. Appl. No. 10/762,936, dated Jan. 31, 2005.

Office Action for U.S. Appl. No. 10/762,594, dated Jan. 26, 2005.

Office Action for U.S. Appl. No. 10/762,936, dated Aug. 9, 2005.

Office Action for U.S. Appl. No. 10/762,594, dated Jul. 15, 2005.

* cited by examiner

METHODS OF DOWNHOLE TESTING SUBTERRANEAN FORMATIONS AND ASSOCIATED APPARATUS THEREFOR

CROSS-REFERENCE TO RELATED APPLICATIONS

The present application is a division of application Ser. No. 10/270,424 filed Oct. 11, 2002, now U.S. Pat. No. 6,729,398 which was a continuation of application Ser. No. 09/971,205 filed Oct. 4, 2001, now U.S. Pat. No. 6,527,052, which was a division of application Ser. No. 09/378,124 filed Aug. 19, 1999, now U.S. Pat. No. 6,325,146, which claims the benefit of the Mar. 31, 1999 filing date of provisional application Ser. No. 60/127,106. The disclosure of each of these earlier applications is incorporated herein in its entirety by this reference.

BACKGROUND OF THE INVENTION

The present invention relates generally to operations performed in conjunction with subterranean wells and, in an embodiment described herein, more particularly provides a method of performing a downhole test of a subterranean formation.

In a typical well test known as a drill stem test, a drill string is installed in a well with specialized drill stem test equipment interconnected in the drill string. The purpose of the test is generally to evaluate the potential profitability of completing a particular formation or other zone of interest, and thereby producing hydrocarbons from the formation. Of course, if it is desired to inject fluid into the formation, then the purpose of the test may be to determine the feasibility of such an injection program.

In a typical drill stem test, fluids are flowed from the formation, through the drill string and to the earth's surface at various flow rates, and the drill string may be closed to flow therethrough at least once during the test. Unfortunately, the formation fluids have in the past been exhausted to the atmosphere during the test, or otherwise discharged to the environment, many times with hydrocarbons therein being burned off in a flare. It will be readily appreciated that this procedure presents not only environmental hazards, but safety hazards as well.

Therefore, it would be very advantageous to provide a method whereby a formation may be tested, without discharging hydrocarbons or other formation fluids to the environment, or without flowing the formation fluids to the earth's surface. It would also be advantageous to provide apparatus for use in performing the method.

SUMMARY OF THE INVENTION

In carrying out the principles of the present invention, in accordance with an embodiment thereof, a method is provided in which a formation test is performed downhole, without flowing formation fluids to the earth's surface, or without discharging the fluids to the environment. Also provided are associated apparatus for use in performing the method.

In one aspect of the present invention, a method includes steps wherein a formation is perforated, and fluids from the formation are flowed into a large surge chamber associated with a tubular string installed in the well. Of course, if the well is uncased, the perforation step is unnecessary. The surge chamber may be a portion of the tubular string. Valves are provided above and below the surge chamber, so that the formation fluids may be flowed, pumped or reinjected back into the formation after the test, or the fluids may be circulated (or reverse circulated) to the earth's surface for analysis.

In another aspect of the present invention, a method includes steps wherein fluids from a first formation are flowed into a tubular string installed in the well, and the fluids are then disposed of by injecting the fluids into a second formation. The disposal operation may be performed by alternately applying fluid pressure to the tubular string, by operating a pump in the tubular string, by taking advantage of a pressure differential between the formations, or by other means. A sample of the formation fluid may conveniently be brought to the earth's surface for analysis by utilizing apparatus provided by the present invention.

In yet another aspect of the present invention, a method includes steps wherein fluids are flowed from a first formation and into a second formation utilizing an apparatus which may be conveyed into a tubular string positioned in the well. The apparatus may include a pump which may be driven by fluid flow through a fluid conduit, such as coiled tubing, attached to the apparatus. The apparatus may also include sample chambers therein for retrieving samples of the formation fluids.

In each of the above methods, the apparatus associated therewith may include various fluid property sensors, fluid and solid identification sensors, flow control devices, instrumentation, data communication devices, samplers, etc., for use in analyzing the test progress, for analyzing the fluids and/or solid matter flowed from the formation, for retrieval of stored test data, for real time analysis and/or transmission of test data, etc.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
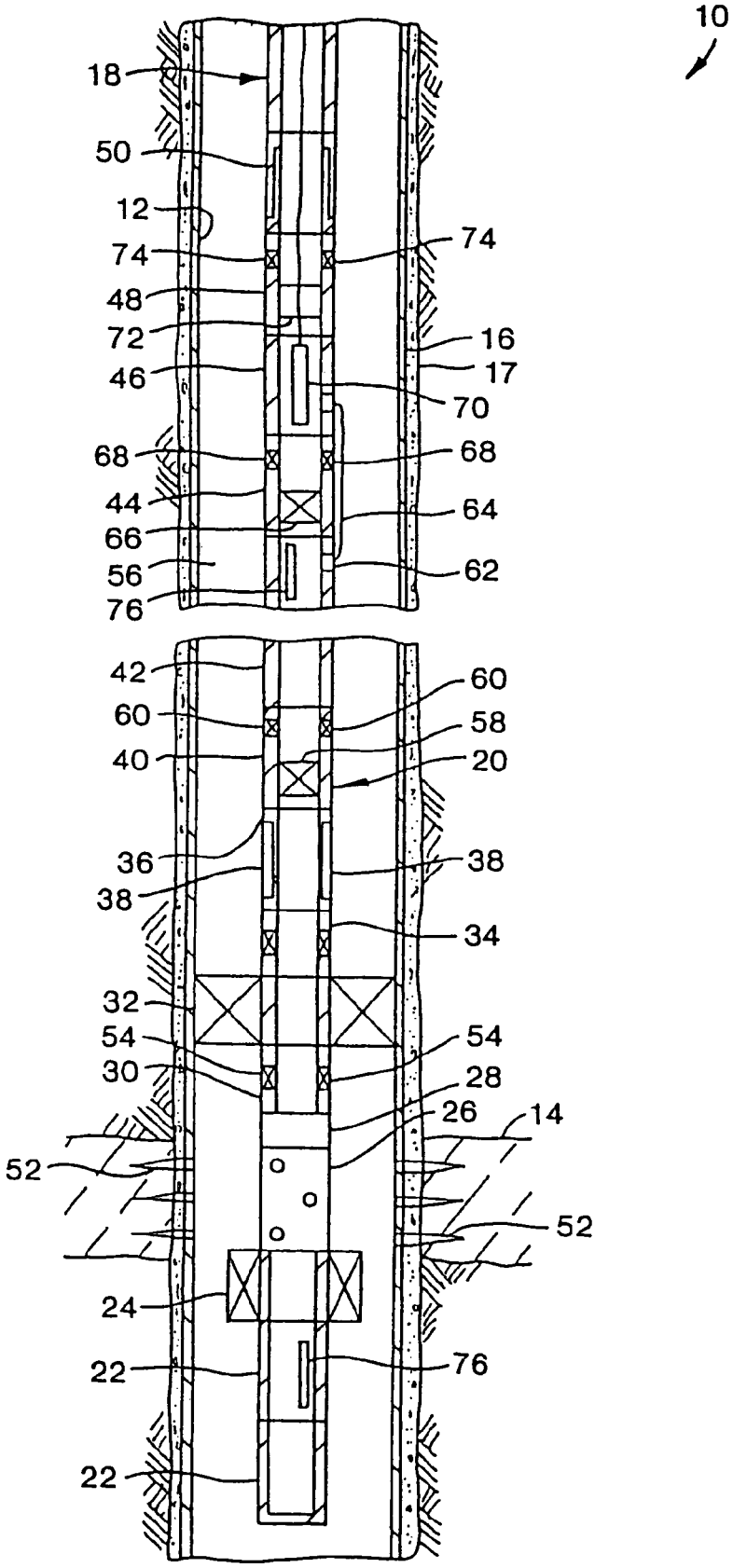
FIG. 1 is a schematic cross-sectional view of a well wherein a first method and apparatus embodying principles of the present invention are utilized for testing a formation.

Representatively illustrated in FIG. 1 is a method 10 which embodies principles of the present invention. In the following description of the method 10 and other apparatus and methods described herein, directional terms, such as "above", "below", "upper", "lower", etc., are used for convenience in referring to the accompanying drawings.

Additionally, it is to be understood that the various embodiments of the present invention described herein may be utilized in various orientations, such as inclined, inverted, horizontal, vertical, etc., without departing from the principles of the present invention.

In the method 10 as representatively depicted in FIG. 1, a wellbore 12 has been drilled intersecting a formation or zone of interest 14, and the wellbore has been lined with casing 16 and cement 17. In the further description of the method 10 below, the wellbore 12 is referred to as the interior of the casing 16, but it is to be clearly understood that, with appropriate modification in a manner well understood by those skilled in the art, a method incorporating principles of the present invention may be performed in an uncased wellbore, and in that situation the wellbore would more appropriately refer to the uncased bore of the well.

A tubular string 18 is conveyed into the wellbore 12. The string 18 may consist mainly of drill pipe, or other segmented tubular members, or it may be substantially unsegmented, such as coiled tubing. At a lower end of the string 18, a formation test assembly 20 is interconnected in the string.

The assembly 20 includes the following items of equipment, in order beginning at the bottom of the assembly as representatively depicted in FIG. 1: one or more generally tubular waste chambers 22, an optional packer 24, one or more perforating guns 26, a firing head 28, a circulating valve 30, a packer 32, a circulating valve 34, a gauge carrier 36 with associated gauges 38, a tester valve 40, a tubular surge chamber 42, a tester valve 44, a data access sub 46, a safety circulation valve 48, and a slip joint 50. Note that several of these listed items of equipment are optional in the method 10, other items of equipment may be substituted for some of the listed items of equipment, and/or additional items of equipment may be utilized in the method and, therefore, the assembly 20 depicted in FIG. 1 is to be considered as merely representative of an assembly which may be used in a method incorporating principles of the present invention, and not as an assembly which must necessarily be used in such method.

The waste chambers 22 may be comprised of hollow tubular members, for example, empty perforating guns (i.e., with no perforating charges therein). The waste chambers 22 are used in the method 10 to collect waste from the wellbore 12 immediately after the perforating gun 26 is fired to perforate the formation 14. This waste may include perforating debris, wellbore fluids, formation fluids, formation sand, etc. Additionally, the pressure reduction in the wellbore 12 created when the waste chambers 22 are opened to the wellbore may assist in cleaning perforations 52 created by the perforating gun 26, thereby enhancing fluid flow from the formation 14 during the test. In general, the waste chambers 22 are utilized to collect waste from the wellbore 12 and perforations 52 prior to performing the actual formation test, but other purposes may be served by the waste chambers, such as drawing unwanted fluids out of the formation 14, for example, fluids injected therein during the well drilling process.

The packer 24 may be used to straddle the formation 14 if another formation therebelow is open to the wellbore 12, a large rathole exists below the formation, or if it is desired to inject fluids flowed from the formation 14 into another fluid disposal formation as described in more detail below. The packer 24 is shown unset in FIG. 1 as an indication that its use is not necessary in the method 10, but it could be included in the string 18, if desired.

The perforating gun 26 and associated firing head 28 may be any conventional means of forming an opening from the wellbore 12 to the formation 14. Of course, as described above, the well may be uncased at its intersection with the formation 14. Alternatively, the formation 14 may be perforated before the assembly 20 is conveyed into the well, the formation may be perforated by conveying a perforating gun through the assembly after the assembly is conveyed into the well, etc.

The circulating valve 30 is used to selectively permit fluid communication between the wellbore 12 and the interior of the assembly 20 below the packer 32, so that formation fluids may be drawn into the interior of the assembly above the packer. The circulating valve 30 may include openable ports 54 for permitting fluid flow therethrough after the perforating gun 26 has fired and waste has been collected in the waste chambers 22.

The packer 32 isolates an annulus 56 above the packer formed between the string 18 and the wellbore 12 from the wellbore below the packer. As depicted in FIG. 1, the packer 32 is set in the wellbore 12 when the perforating gun 26 is positioned opposite the formation 14, and before the gun is fired. The circulating valve 34 may be interconnected above the packer 32 to permit circulation of fluid through the assembly 20 above the packer, if desired.

The gauge carrier 36 and associated gauges 38 are used to collect test data, such as pressure, temperature, etc., during the formation test. It is to be clearly understood that the gauge carrier 36 is merely representative of a variety of means which may be used to collect such data. For example, pressure and/or temperature gauges may be included in the surge chamber 42 and/or the waste chambers 22. Additionally, note that the gauges 38 may acquire data from the interior of the assembly 20 and/or from the annulus 56 above and/or below the packer 32. Preferably, one or more of the gauges 38, or otherwise positioned gauges, records fluid pressure and temperature in the annulus 56 below the packer 32, and between the packers 24, 32 if the packer 24 is used, substantially continuously during the formation test.

The tester valve 40 selectively permits fluid flow axially therethrough and/or laterally through a sidewall thereof. For example, the tester valve 40 may be an "Omni" valve, available from Halliburton Energy Services, Inc., in which case the valve may include a sliding sleeve valve 58 and closeable circulating ports 60. The valve 58 selectively permits and prevents fluid flow axially through the assembly 20, and the ports 60 selectively permit and prevent fluid communication between the interior of the surge chamber 42 and the annulus 56. Other valves, and other types of valves, may be used in place of the representatively illustrated valve 40, without departing from the principles of the present invention.

The surge chamber 42 comprises one or more generally hollow tubular members, and may consist mainly of sections of drill pipe, or other conventional tubular goods, or may be purpose-built for use in the method 10. It is contemplated that the interior of the surge chamber 42 may have a relatively large volume, such as approximately 20 barrels, so that, during the formation test, a substantial volume of fluid may be flowed from the formation 14 into the chamber, a sufficiently low initial drawdown pressure may be achieved during the test, etc. When conveyed into the well, the interior of the surge chamber 42 may be at atmospheric pressure, or it may be at another pressure, if desired.

One or more sensors, such as sensor 62, may be included with the chamber 42, in order to acquire data, such as fluid property data (e.g., pressure, temperature, resistivity, viscosity, density, flow rate, etc.) and/or fluid identification data (e.g., by using nuclear magnetic resonance sensors available from Numar, Inc.). The sensor 62 may be in data communication with the data access sub 46, or another remote location, by any data transmission means, for example, a line 64 extending external or internal relative to the assembly 20, acoustic data transmission, electromagnetic data transmission, optical data transmission, etc.

The valve 44 may be similar to the valve 40 described above, or it may be another type of valve. As representatively depicted in FIG. 1, the valve 44 includes a ball valve 66 and closeable circulating ports 68. The ball valve 66 selectively permits and prevents fluid flow axially through the assembly 20, and the ports 68 selectively permit and prevent fluid communication between the interior of the assembly 20 above the surge chamber 42 and the annulus 56. Other valves, and other types of valves, may be used in place of the representatively illustrated valve 44, without departing from the principles of the present invention.

The data access sub 46 is representatively depicted as being of the type wherein such access is provided by conveying a wireline tool 70 therein in order to acquire the data transmitted from the sensor 62. For example, the data access sub 46 may be a conventional wet connect sub. Such data access may be utilized to retrieve stored data and/or to provide real time access to data during the formation test. Note that a variety of other means may be utilized for accessing data acquired downhole in the method 10, for example, the data may be transmitted directly to a remote location, other types of tools and data access subs may be utilized, etc.

The safety circulation valve 48 may be similar to the valves 40, 44 described above in that it may selectively permit and prevent fluid flow axially therethrough and through a sidewall thereof. However, preferably the valve 48 is of the type which is used only when a well control emergency occurs. In that instance, a ball valve 72 thereof (which is shown in its typical open position in FIG. 1) would be closed to prevent any possibility of formation fluids flowing further to the earth's surface, and circulation ports 74 would be opened to permit kill weight fluid to be circulated through the string 18.

The slip joint 50 is utilized in the method 10 to aid in positioning the assembly 20 in the well. For example, if the string 18 is to be landed in a subsea wellhead, the slip joint 50 may be useful in spacing out the assembly 20 relative to the formation 14 prior to setting the packer 32.

In the method 10, the perforating guns 26 are positioned opposite the formation 14 and the packer 32 is set. If it is desired to isolate the formation 14 from the wellbore 12 below the formation, the optional packer 24 may be included in the string 18 and set so that the packers 32, 24 straddle the formation. The formation 14 is perforated by firing the gun 26, and the waste chambers 22 are immediately and automatically opened to the wellbore 12 upon such gun firing. For example, the waste chambers 22 may be in fluid communication with the interior of the perforating gun 26, so that when the gun is fired, flow paths are provided by the detonated perforating charges through the gun sidewall. Of course, other means of providing such fluid communication may be provided, such as by a pressure operated device, a detonation operated device, etc., without departing from the principles of the present invention.

At this point, the ports 54 may or may not be open, as desired, but preferably the ports are open when the gun 26 is fired. If not previously opened, the ports 54 are opened after the gun 26 is fired. This permits flow of fluids from the formation 14 into the interior of the assembly 20 above the packer 32.

When it is desired to perform the formation test, the tester valve 40 is opened by opening the valve 58, thereby permitting the formation fluids to flow into the surge chamber 42 and achieving a drawdown on the formation 14. The gauges 38 and sensor 62 acquire data indicative of the test, which, as described above, may be retrieved later or evaluated simultaneously with performance of the test. One or more conventional fluid samplers 76 may be positioned within, or otherwise in communication with, the chamber 42 for collection of one or more samples of the formation fluid. One or more of the fluid samplers 76 may also be positioned within, or otherwise in communication with, the waste chambers 22.

After the test, the valve 66 is opened and the ports 60 are opened, and the formation fluids in the surge chamber 42 are reverse circulated out of the chamber. Other circulation paths, such as the circulating valve 34, may also be used. Alternatively, fluid pressure may be applied to the string 18 at the earth's surface before unsetting the packer 32, and with valves 58, 66 open, to flow the formation fluids back into the formation 14. As another alternative, the assembly 20 may be repositioned in the well, so that the packers 24, 32 straddle another formation intersected by the well, and the formation fluids may be flowed into this other formation. Thus, it is not necessary in the method 10 for formation fluids to be conveyed to the earth's surface unless desired, such as in the sampler 76, or by reverse circulating the formation fluids to the earth's surface.

Figure 2:
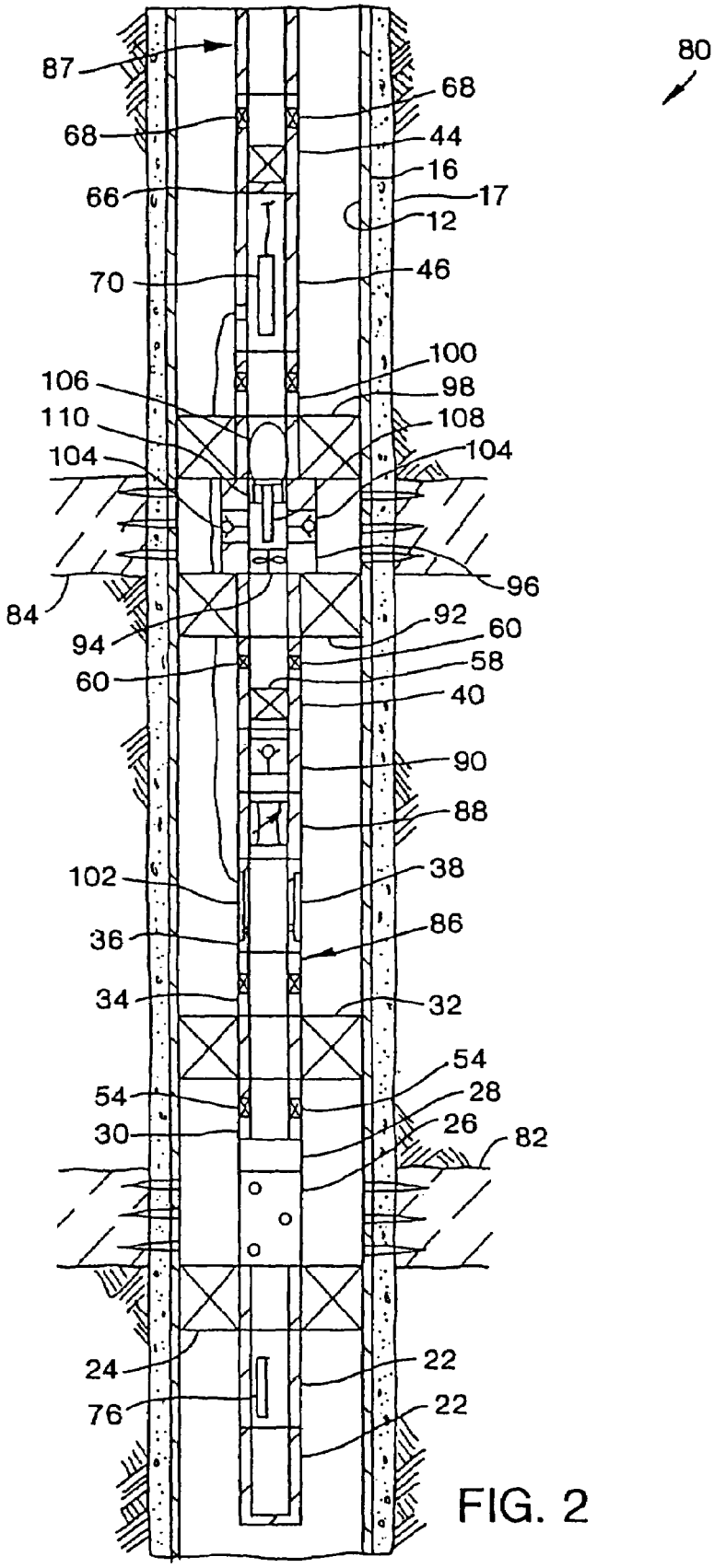
FIG. 2 is a schematic cross-sectional view of a well wherein a second method and apparatus embodying principles of the present invention are utilized for testing a formation.

Referring additionally now to FIG. 2, another method 80 embodying principles of the present invention is representatively depicted. In the method 80, formation fluids are transferred from a formation 82 from which they originate, into another formation 84 for disposal, without it being necessary to flow the fluids to the earth's surface during a formation test, although the fluids may be conveyed to the earth's surface if desired. As depicted in FIG. 2, the disposal formation 84 is located uphole from the tested formation 82, but it is to be clearly understood that these relative positionings could be reversed with appropriate changes to the apparatus and method described below, without departing from the principles of the present invention.

A formation test assembly 86 is conveyed into the well interconnected in a tubular string 87 at a lower end thereof. The assembly 86 includes the following, listed beginning at the bottom of the assembly: the waste chambers 22, the packer 24, the gun 26, the firing head 28, the circulating valve 30, the packer 32, the circulating valve 34, the gauge carrier 36, a variable or fixed choke 88, a check valve 90, the tester valve 40, a packer 92, an optional pump 94, a disposal sub 96, a packer 98, a circulating valve 100, the data access sub 46, and the tester valve 44. Note that several of these listed items of equipment are optional in the method 80, other items of equipment may be substituted for some of the listed items of equipment, and/or additional items of equipment may be utilized in the method and, therefore, the assembly 86 depicted in FIG. 2 is to be considered as merely representative of an assembly which may be used in a method incorporating principles of the present invention, and not as an assembly which must necessarily be used in such method. For example, the valve 40, check valve 90 and choke 88 are shown as examples of flow control devices which may be installed in the assembly 86 between the formations 82, 84, and other flow control devices, or other types of flow control devices, may be utilized in the method 80, in keeping with the principles of the present invention. As another example, the pump 94 may be used, if desired, to pump fluid from the test formation 82, through the assembly 86 and into the disposal formation 84, but use of the pump 94 is not necessary in the method 80. Additionally, many of the items of equipment in the assembly 86 are shown as being the same as respective items of equipment used in the method 10 described above, but this is not necessarily the case.

When the assembly 86 is conveyed into the well, the disposal formation 84 may have already been perforated, or the formation may be perforated by providing one or more additional perforating guns in the assembly, if desired. For example, additional perforating guns could be provided below the waste chambers 22 in the assembly 86.

The assembly 86 is positioned in the well with the gun 26 opposite the test formation 82, the packers 24, 32, 92, 98 are set, the circulating valve 30 is opened, if desired, if not already open, and the gun 26 is fired to perforate the formation. At this point, with the test formation 82 perforated, waste is immediately received into the waste chambers 22 as described above for the method 10. The circulating valve 30 is opened, if not done previously, and the test formation is thereby placed in fluid communication with the interior of the assembly 86.

Preferably, when the assembly 86 is positioned in the well as shown in FIG. 2, a relatively low density fluid (liquid, gas (including air, at atmospheric or greater or lower pressure) and/or combinations of liquids and gases, etc.) is contained in the string 87 above the upper valve 44. This creates a low hydrostatic pressure in the string 87 relative to fluid pressure in the test formation 82, which pressure differential is used to draw fluids from the test formation into the assembly 86 as described more fully below. Note that the fluid preferably has a density which will create a pressure differential from the formation 82 to the interior of the assembly at the ports 54 when the valves 58, 66 are open. However, it is to be clearly understood that other methods and means of drawing formation fluids into the assembly 86 may be utilized, without departing from the principles of the present invention. For example, the low density fluid could be circulated into the string 87 after positioning it in the well by opening the ports 68, nitrogen could be used to displace fluid out of the string, a pump 94 could be used to pump fluid from the test formation 82 into the string, a difference in formation pressure between the two formations 82, 84 could be used to induce flow from the higher pressure formation to the lower pressure formation, etc.

After perforating the test formation 82, fluids are flowed into the assembly 86 via the circulation valve 30 as described above, by opening the valves 58, 66. Preferably, a sufficiently large volume of fluid is initially flowed out of the test formation 82, so that undesired fluids, such as drilling fluid, etc., in the formation are withdrawn from the formation. When one or more sensors, such as a resistivity or other fluid property or fluid identification sensor 102, indicates that representative desired formation fluid is flowing into the assembly 86, the lower valve 58 is closed. Note that the sensor 102 may be of the type which is utilized to indicate the presence and/or identity of solid matter in the formation fluid flowed into the assembly 86.

Pressure may then be applied to the string 87 at the earth's surface to flow the undesired fluid out through check valves 104 and into the disposal formation 84. The lower valve 58 may then be opened again to flow further fluid from the test formation 82 into the assembly 86. This process may be repeated as many times as desired to flow substantially any volume of fluid from the formation 82 into the assembly 86, and then into the disposal formation 84.

Data acquired by the gauges 38 and/or sensors 102 while fluid is flowing from the formation 82 through the assembly 86 (when the valves 58, 66 are open), and while the formation 82 is shut in (when the valve 58 is closed) may be analyzed after or during the test to determine characteristics of the formation 82. Of course, gauges and sensors of any type may be positioned in other portions of the assembly 86, such as in the waste chambers 22, between the valves 58, 66, etc. For example, pressure and temperature sensors and/or gauges may be positioned between the valves 58, 66, which would enable the acquisition of data useful for injection testing of the disposal zone 84, during the time the lower valve 58 is closed and fluid is flowed from the assembly 86 outward into the formation 84.

It will be readily appreciated that, in this fluid flowing process as described above, the valve 58 is used to permit flow upwardly therethrough, and then the valve is closed when pressure is applied to the string 87 to dispose of the fluid. Thus, the valve 58 could be replaced by the check valve 90, or the check valve may be supplied in addition to the valve as depicted in FIG. 2.

If a difference in formation pressure between the formations 82, 84 is used to flow fluid from the formation 82 into the assembly 86, then a variable choke 88 may be used to regulate this fluid flow. Of course, the variable choke 88 could be provided in addition to other flow control devices, such as the valve 58 and check valve 90, without departing from the principles of the present invention.

If a pump 94 is used to draw fluid into the assembly 86, no flow control devices may be needed between the disposal formation 84 and the test formation 82, the same or similar flow control devices depicted in FIG. 2 may be used, or other flow control devices may be used. Note that, to dispose of fluid drawn into the assembly 86, the pump 94 is operated with the valve 66 closed.

In a similar manner, the check valves 104 of the disposal sub 96 may be replaced with other flow control devices, other types of flow control devices, etc.

To provide separation between the low density fluid in the string 87 and the fluid drawn into the assembly 86 from the test formation 82, a fluid separation device or plug 106 which may be reciprocated within the assembly 86 may be used. The plug 106 would also aid in preventing any gas in the fluid drawn into the assembly 86 from being transmitted to the earth's surface. An acceptable plug for this application is the Omega™ plug available from Halliburton Energy Services, Inc. Additionally, the plug 106 may have a fluid sampler 108 attached thereto, which may be activated to take a sample of the formation fluid drawn into the assembly 86 when desired. For example, when the sensor 102 indicates that the desired representative formation fluid has been flowed into the assembly 86, the plug 106 may be deployed with the sampler 108 attached thereto in order to obtain a sample of the formation fluid. The plug 106 may then be reverse circulated to the earth's surface by opening the circulation valve 100. Of course, in that situation, the plug 106 should be retained uphole from the valve 100.

A nipple, no-go 110, or other engagement device may be provided to prevent the plug 106 from displacing downhole past the disposal sub 96. When applying pressure to the string 87 to flow the fluid in the assembly 86 outward into the disposal formation 84, such engagement between the plug 106 and the device 110 may be used to provide a positive indication at the earth's surface that the pumping operation is completed. Additionally, a no-go or other displacement limiting device could be used to prevent the plug 106 from circulating above the upper valve 44 to thereby provide a type of downhole safety valve, if desired.

The sampler 108 could be configured to take a sample of the fluid in the assembly 86 when the plug 106 engages the device 110. Note, also, that use of the device 110 is not necessary, since it may be desired to take a sample with the sampler 108 of fluid in the assembly 86 below the disposal sub 96, etc. The sampler could alternatively be configured to take a sample after a predetermined time period, in response to pressure applied thereto (such as hydrostatic pressure), etc.

An additional one of the plug 106 may be deployed in order to capture a sample of the fluid in the assembly 86 between the plugs, and then convey this sample to the surface, with the sample still retained between the plugs. This may be accomplished by use of a plug deployment sub, such as that representatively depicted in FIG. 3. Thus, after fluid from the formation 82 is drawn into the assembly 86, the second plug 106 is deployed, thereby capturing a sample of the fluid between the two plugs. The sample may then be circulated to the earth's surface between the two plugs 106 by, for example, opening the circulating valve 100 and reverse circulating the sample and plugs uphole through the string 87.

Figure 3:
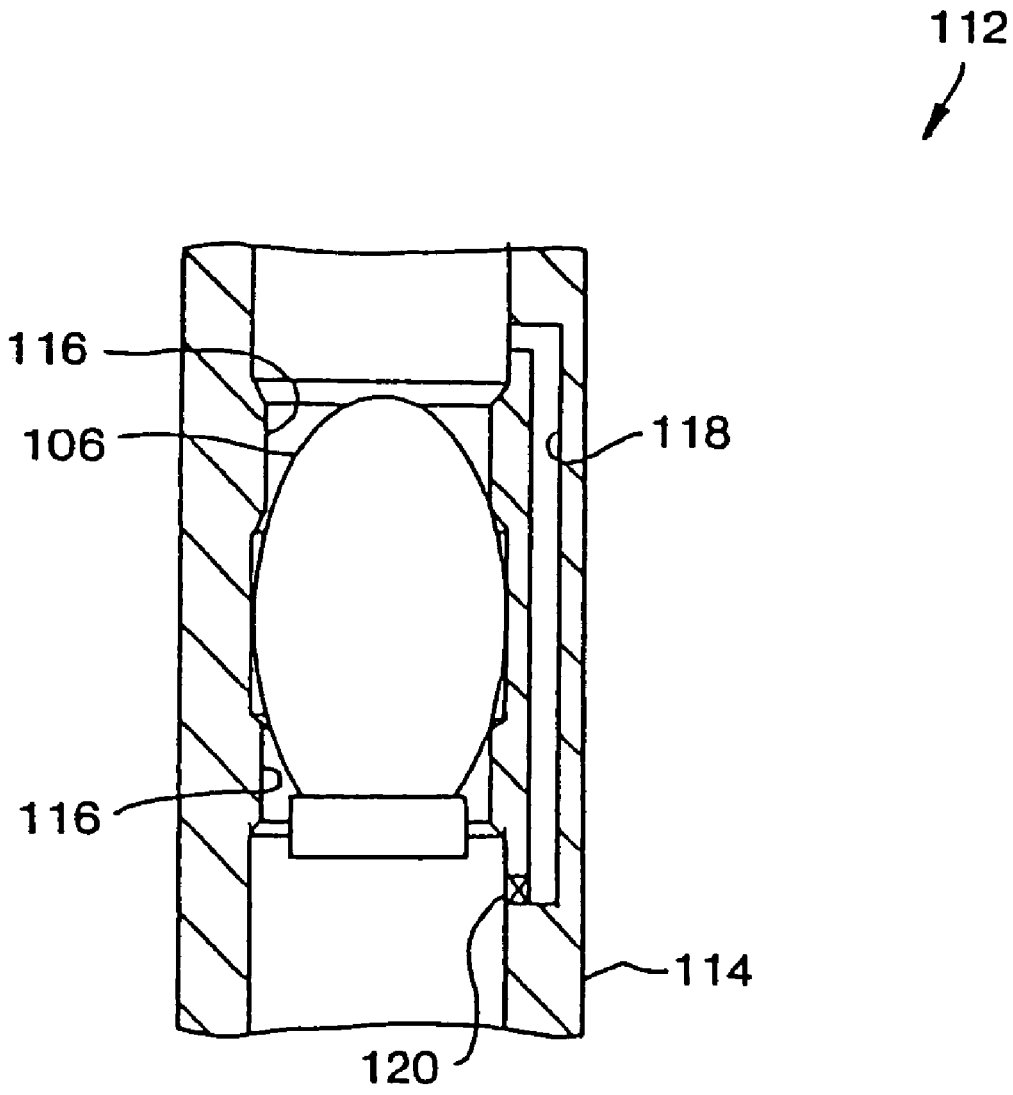
FIG. 3 is an enlarged scale schematic cross-sectional view of a device which may be used in the second method.

Referring additionally now to FIG. 3, a fluid separation device or plug deployment sub 112 embodying principles of the present invention is representatively depicted. A plug 106 is releasably secured in a housing 114 of the sub 112 by positioning it between two radially reduced restrictions 116. If the plug 106 is an Omega™ plug, it is somewhat flexible and can be made to squeeze through either of the restrictions 116 if a sufficient pressure differential is applied across the plug. Of course, either of the restrictions could be made sufficiently small to prevent passage of the plug 106 therethrough, if desired. For example, if it is desired to permit the plug 106 to displace upwardly through the assembly 86 above the sub 112, but not to displace downwardly past the sub 112, then the lower restriction 116 may be made sufficiently small, or otherwise configured, to prevent passage of the plug therethrough.

A bypass passage 118 formed in a sidewall of the housing 114 permits fluid flow therethrough from above, to below, the plug 106, when a valve 120 is open. Thus, when fluid is being drawn into the assembly 86 in the method 80, the sub 112, even though the plug 106 may remain stationary with respect to the housing 114, does not effectively prevent fluid flow through the assembly. However, when the valve 120 is closed, a pressure differential may be created across the plug 106, permitting the plug to be deployed for reciprocal movement in the string 87. The sub 112 may be interconnected in the assembly 86, for example, below the upper valve 66 and below the plug 106 shown in FIG. 2.

If a pump, such as pump 94 is used to draw fluid from the formation 82 into the assembly 86, then use of the low density fluid in the string 87 is unnecessary. With the upper valve 66 closed and the lower valve 58 open, the pump 94 may be operated to flow fluid from the formation 82 into the assembly 86, and outward through the disposal sub 96 into the disposal formation 84. The pump 94 may be any conventional pump, such as an electrically operated pump, a fluid operated pump, etc.

Figure 4:
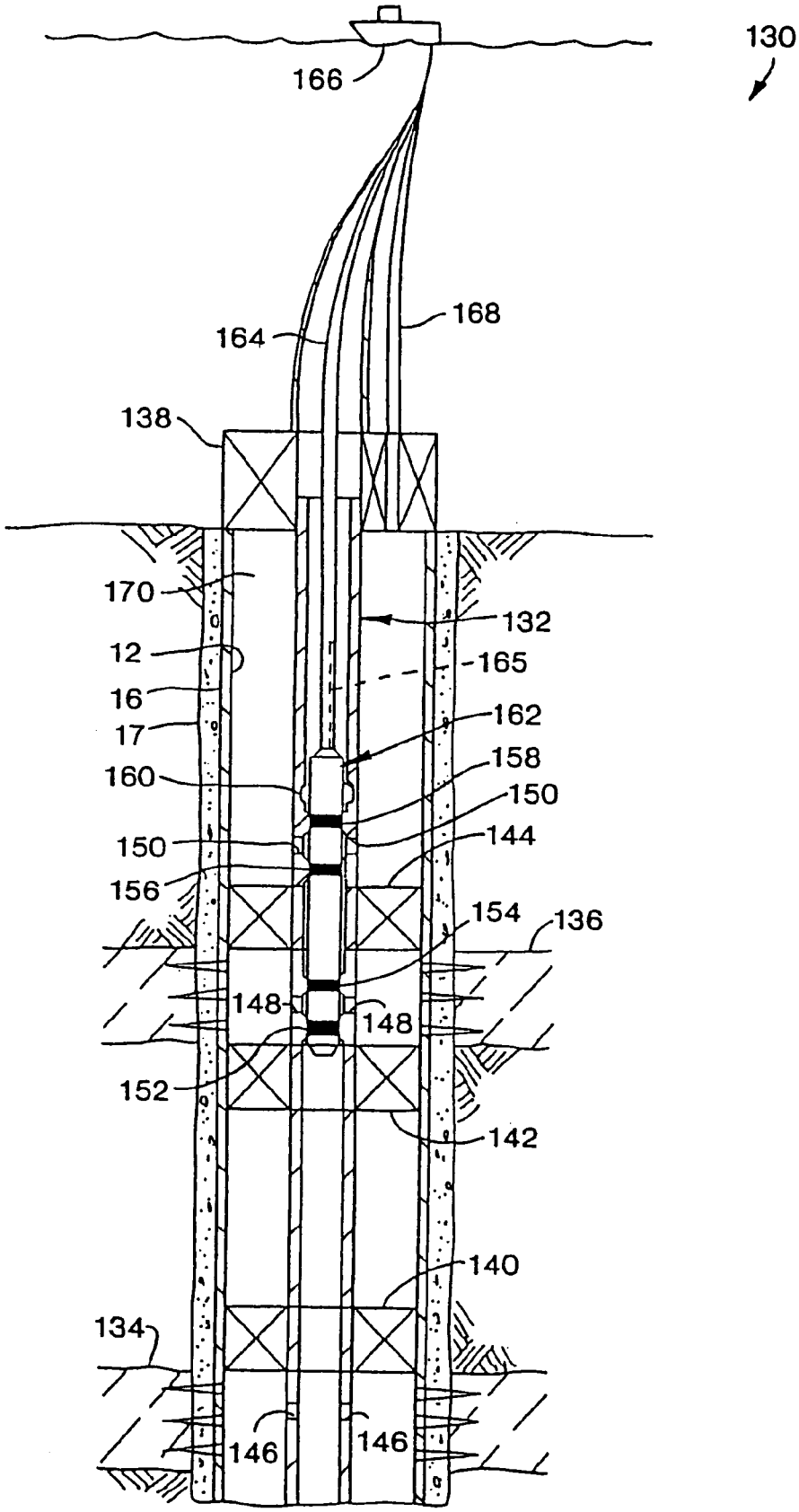
FIG. 4 is a schematic cross-sectional view of a well wherein a third method and apparatus embodying principles of the present invention are utilized for testing a formation.

Referring additionally now to FIG. 4, another method 130 of performing a formation test embodying principles of the present invention is representatively depicted. The method 130 is described herein as being used in a "rigless" scenario, i.e., in which a drilling rig is not present at the time the actual test is performed, but it is to be clearly understood that such is not necessary in keeping with the principles of the present invention. Note that the method 80 could also be performed rigless, if a downhole pump is utilized in that method. Additionally, although the method 130 is depicted as being performed in a subsea well, a method incorporating principles of the present invention may be performed on land as well.

In the method 130, a tubular string 132 is positioned in the well, preferably after a test formation 134 and a disposal formation 136 have been perforated. However, it is to be understood that the formations 134, 136 could be perforated when or after the string 132 is conveyed into the well. For example, the string 132 could include perforating guns, etc., to perforate one or both of the formations 134, 136 when the string is conveyed into the well.

The string 132 is preferably constructed mainly of a composite material, or another easily milled/drilled material. In this manner, the string 132 may be milled/drilled away after completion of the test, if desired, without the need of using a drilling or workover rig to pull the string. For example, a coiled tubing rig could be utilized, equipped with a drill motor, for disposing of the string 132.

When initially run into the well, the string 132 may be conveyed therein using a rig, but the rig could then be moved away, thereby providing substantial cost savings to the well operator. In any event, the string 132 is positioned in the well and, for example, landed in a subsea wellhead 138.

The string 132 includes packers 140, 142, 144. Another packer may be provided if it is desired to straddle the test formation 134, as the test formation 82 is straddled by the packers 24, 32 shown in FIG. 2. The string 132 further includes ports 146, 148, 150 spaced as shown in FIG. 4, i.e., ports 146 positioned below the packer 140, ports 148 between the packers 142, 144, and ports 150 above the packer 144. Additionally the string 132 includes seal bores 152, 154, 156, 158 and a latching profile 160 therein for engagement with a tester tool 162 as described more fully below.

The tester tool 162 is preferably conveyed into the string 132 via coiled tubing 164 of the type which has an electrical conductor 165 therein, or another line associated therewith, which may be used for delivery of electrical power, data transmission, etc., between the tool 162 and a remote location, such as a service vessel 166. The tester tool 162 could alternatively be conveyed on wireline or electric line. Note that other methods of data transmission, such as acoustic, electromagnetic, fiber optic etc. may be utilized in the method 130, without departing from the principles of the present invention.

A return flow line 168 is interconnected between the vessel 166 and an annulus 170 formed between the string 132 and the wellbore 12 above the upper packer 144. This annulus 170 is in fluid communication with the ports 150 and permits return circulation of fluid flowed to the tool 162 via the coiled tubing 164 for purposes described more fully below.

The ports 146 are in fluid communication with the test formation 134 and, via the interior of the string 132, with the lower end of the tool 162. As described below, the tool 162 is used to pump fluid from the formation 134, via the ports 146, and out into the disposal formation 136 via the ports 148.

Figure 5:
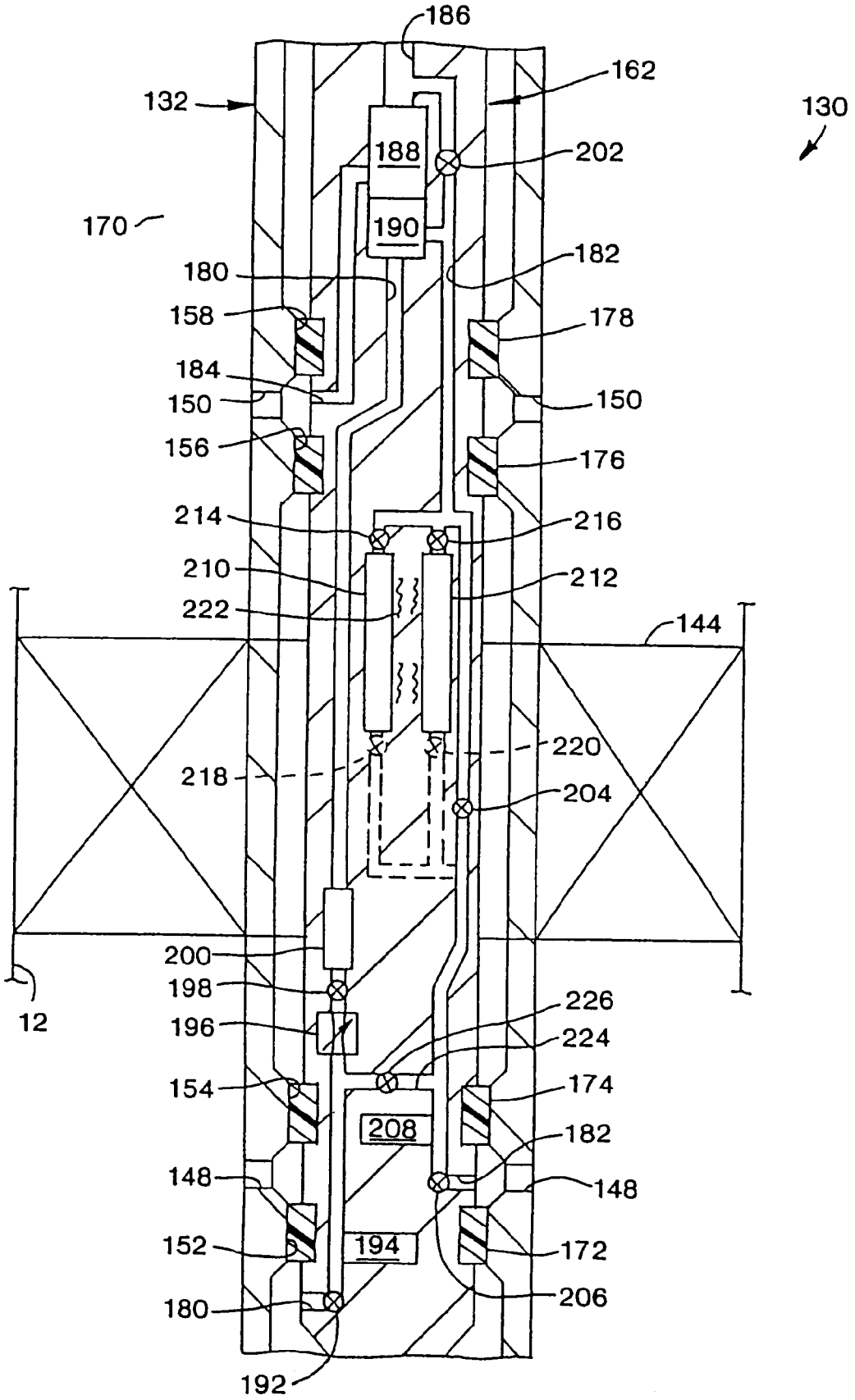
FIG. 5 is an enlarged scale schematic cross-sectional view of a device which may be used in the third method.

Referring additionally now to FIG. 5, the tester tool 162 is schematically and representatively depicted engaged within the string 132, but apart from the remainder of the well as shown in FIG. 4 for illustrative clarity. Seals 172, 174, 176, 178 sealingly engage bores 152, 154, 156, 158, respectively. In this manner, a flow passage 180 near the lower end of the tool 162 is in fluid communication with the interior of the string 132 below the ports 148, but the passage is isolated from the ports 148 and the remainder of the string above the seal bore 152; a passage 182 is placed in fluid communication with the ports 148 between the seal bores 152, 154 and, thereby, with the disposal formation 136; and a passage 184 is placed in fluid communication with the ports 150 between the seal bores 156, 158 and, thereby, with the annulus 170.

An upper passage 186 is in fluid communication with the interior of the coiled tubing 164. Fluid is pumped down the coiled tubing 164 and into the tool 162 via the passage 186, where it enters a fluid motor or mud motor 188. The motor 188 is used to drive a pump 190. However, the pump 190 could be an electrically-operated pump, in which case the coiled tubing 164 could be a wireline and the passages 186, 184, seals 176, 178, seal bores 156, 158, and ports 150 would be unnecessary. The pump 190 draws fluid into the tool 162 via the passage 180, and discharges it from the tool via the passage 182. The fluid used to drive the motor 188 is discharged via the passage 184, enters the annulus, and is returned via the line 168.

Interconnected in the passage 180 are a valve 192, a fluid property sensor 194, a variable choke 196, a valve 198, and a fluid identification sensor 200. The fluid property sensor 194 may be a pressure, temperature, resistivity, density, flow rate, etc. sensor, or any other type of sensor, or combination of sensors, and may be similar to any of the sensors described above. The fluid identification sensor 200 may be a nuclear magnetic resonance sensor, an acoustic sand probe, or any other type of sensor, or combination of sensors. Preferably, the sensor 194 is used to obtain data regarding physical properties of the fluid entering the tool 162, and the sensor 200 is used to identify the fluid itself, or any solids, such as sand, carried therewith. For example, if the pump 190 is operated to produce a high rate of flow from the formation 134, and the sensor 200 indicates that this high rate of flow results in an undesirably large amount of sand production from the formation, the operator will know to produce the formation at a lower flow rate. By pumping at different rates, the operator can determine at what fluid velocity sand is produced, etc. The sensor 200 may also enable the operator to tailor a gravel pack completion to the grain size of the sand identified by the sensor during the test.

The flow controls 192, 196, 198 are merely representative of flow controls which may be provided with the tool 162. These are preferably electrically operated by means of the electrical line 165 associated with the coiled tubing 164 as described above, although they may be otherwise operated, without departing from the principles of the present invention.

After exiting the pump 190, fluid from the formation 134 is discharged into the passage 182. The passage 182 has valves 202, 204, 206, sensor 208, and sample chambers 210, 212 associated therewith. The sensor 208 may be of the same type as the sensor 194, and is used to monitor the properties, such as pressure, of the fluid being injected into the disposal formation 136. Each sample chamber has a valve 214, 216 for interconnecting the chamber to the passage 182 and thereby receiving a sample therein. Each sample chamber may also have another valve 218, 220 (shown in dashed lines in FIG. 5) for discharge of fluid from the sample chamber into the passage 182. Each of the valves 202, 204, 206, 214, 216, 218, 220 may be electrically operated via the coiled tubing 164 electrical line as described above.

The sensors 194, 200, 208 may be interconnected to the line 165 for transmission of data to a remote location. Of course, other means of transmitting this data, such as acoustic, electromagnetic, etc., may be used in addition, or in the alternative. Data may also be stored in the tool 162 for later retrieval with the tool.

To perform a test, the valves 192, 198, 204, 206 are opened and the pump 190 is operated by flowing fluid through the passages 184, 186 via the coiled tubing 164. Fluid from the formation 134 is, thus, drawn into the passage 180 and discharged through the passage 182 into the disposal formation 136 as described above.

When one or more of the sensors 194, 200 indicate that desired representative formation fluid is flowing through the tool 162, one or both of the samplers 210, 212 is opened via one or more of the valves 214, 216, 218, 220 to collect a sample of the formation fluid. The valve 206 may then be closed, so that the fluid sample may be pressurized to the formation 134 pressure in the samplers 210, 212 before closing the valves 214, 216, 218, 220. One or more electrical heaters 222 may be used to keep a collected sample at a desired reservoir temperature as the tool 162 is retrieved from the well after the test.

Note that the pump 190 could be operated in reverse to perform an injection test on the formation 134. A microfracture test could also be performed in this manner to collect data regarding hydraulic fracturing pressures, etc. Another formation test could be performed after the microfracture test to evaluate the results of the microfracture operation. As another alternative, a chamber of stimulation fluid, such as acid, could be carried with the tool 162 and pumped into the formation 134 by the pump 190. Then, another formation test could be performed to evaluate the results of the stimulation operation. Note that fluid could also be pumped directly from the passage 186 to the passage 180 using a suitable bypass passage 224 and valve 226 to directly pump stimulation fluids into the formation 134, if desired.

The valve 202 is used to flush the passage 182 with fluid from the passage 186, if desired. To do this, the valves 202, 204, 206 are opened and fluid is circulated from the passage 186, through the passage 182, and out into the wellbore 12 via the port 148.

Figure 6:
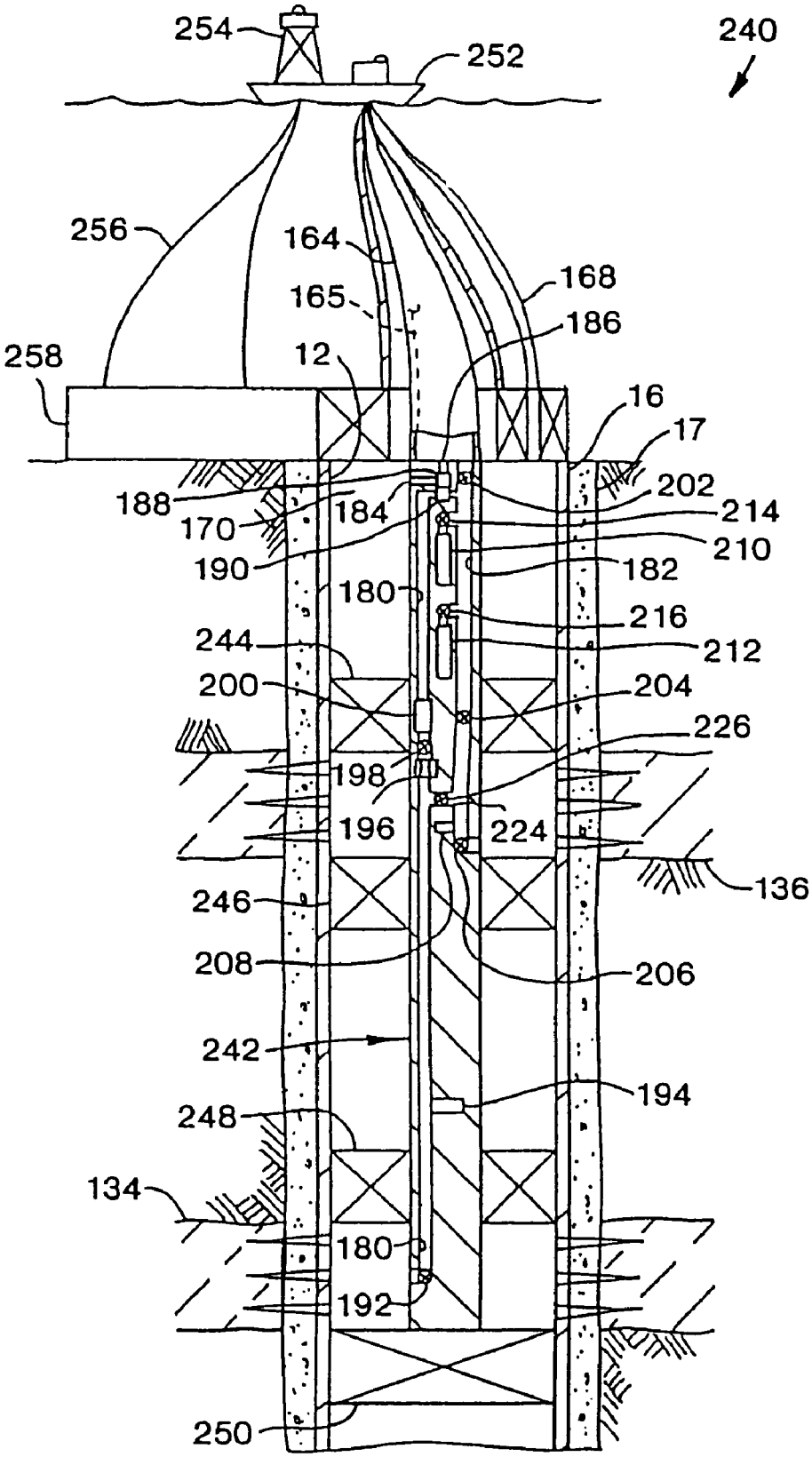
FIG. 6 is a schematic partially cross-sectional view of a fourth method and associated apparatus embodying principles of the present invention.

Referring additionally now to FIG. 6, another method 240 embodying principles of the present invention is representatively illustrated. The method 240 is similar in many respects to the method 130 described above, and elements shown in FIG. 6 which are similar to those previously described are indicated using the same reference numbers.

In the method 240, a tester tool 242 is conveyed into the wellbore 12 on coiled tubing 164 after the formations 134, 136 have been perforated, if necessary. Of course, other means of conveying the tool 242 into the well may be used, and the formations 134, 136 may be perforated after conveyance of the tool into the well, without departing from the principles of the present invention.

The tool 242 differs from the tool 162 described above and shown in FIGS. 4 & 5 in part in that the tool 242 carries packers 244, 246, 248 thereon, and so there is no need to separately install the tubing string 132 in the well as in the method 130. Thus, the method 240 may be performed without the need of a rig to install the tubing string 132. However, it is to be clearly understood that a rig may be used in a method incorporating principles of the present invention.

As shown in FIG. 6, the tool 242 has been conveyed into the well, positioned opposite the formations 134, 136, and the packers 244, 246, 248 have been set. The upper packers 244, 246 are set straddling the disposal formation 136. The passage 182 exits the tool 242 between the upper packers 244, 246, and so the passage is in fluid communication with the formation 136. The packer 248 is set above the test formation 134. The passage 180 exits the tool 242 below the packer 248, and the passage is in fluid communication with the formation 134. A sump packer 250 is shown set in the well below the formation 134, so that the packers 248, 250 straddle the formation 134 and isolate it from the remainder of the well, but it is to be clearly understood that use of the packer 250 is not necessary in the method 240.

Operation of the tool 242 is similar to the operation of the tool 162 as described above. Fluid is circulated through the coiled tubing string 164 to cause the motor 188 to drive the pump 190. In this manner, fluid from the formation 134 is drawn into the tool 242 via the passage 180 and discharged into the disposal formation 136 via the passage 182. Of course, fluid may also be injected into the formation 134 as described above for the method 130, the pump 190 may be electrically operated (e.g., using the line 165 or a wireline on which the tool is conveyed), etc.

Since a rig is not required in the method 240, the method may be performed without a rig present, or while a rig is being otherwise utilized. For example, in FIG. 6, the method 240 is shown being performed from a drill ship 252 which has a drilling rig 254 mounted thereon. The rig 254 is being utilized to drill another wellbore via a riser 256 interconnected to a template 258 on the seabed, while the testing operation of the method 240 is being performed in the adjacent wellbore 12. In this manner, the well operator realizes significant cost and time benefits, since the testing and drilling operations may be performed simultaneously from the same vessel 252.

Data generated by the sensors 194, 200, 208 may be stored in the tool 242 for later retrieval with the tool, or the data may be transmitted to a remote location, such as the earth's surface, via the line 165 or other data transmission means. For example, electromagnetic, acoustic, or other data communication technology may be utilized to transmit the sensor 194, 200, 208 data in real time.

Of course, a person skilled in the art would, upon a careful reading of the above description of representative embodiments of the present invention, readily appreciate that modifications, additions, substitutions, deletions and other changes may be made to these embodiments, and such changes are contemplated by the principles of the present invention. For example, although the methods 10, 80, 130, 240 are described above as being performed in cased wellbores, they may also be performed in uncased wellbores, or uncased portions of wellbores, by exchanging the described packers, tester valves, etc. for their open hole equivalents. The foregoing detailed description is to be clearly understood as being given by way of illustration and example only.

The invention claimed is:

1. A well testing system, comprising:

a formation test assembly positioned in a wellbore of the well, the formation test assembly including an internal chamber divided into first and second portions by a fluid separation device reciprocably received in the chamber, the fluid separation device, during reciprocation thereof within the chamber, being sealingly engaged with the chamber, the first chamber portion being in selective fluid communication with first and second zones intersected by the wellbore, the second chamber portion being in fluid communication with a remote location, the fluid separation device displacing in a first direction in the chamber when formation fluid is flowed into the first chamber portion from the first zone, and the first zone being isolated from the second zone in the wellbore when the formation fluid is flowed into the first chamber portion from the first zone.

2. The system according to claim 1, wherein the formation test assembly further includes a sampler, the sampler taking a sample of the formation fluid in the first chamber portion.

3. The system according to claim 2, wherein the first chamber portion has a volume greater than that of the sampler.

4. The system according to claim 1, wherein the formation test assembly includes a perforating gun which perforates the first zone, thereby permitting fluid flow from the first zone into the first chamber portion.

5. The system according to claim 1, wherein the formation test assembly includes a perforating gun which perforates the second zone, thereby permitting fluid flow from the first chamber portion into the second zone.

6. The system according to claim 1, wherein the formation test assembly includes at least one fluid property sensor, the sensor sensing at least one fluid property of the formation fluid in the first chamber portion.

7. The system according to claim 6, wherein an indication of the fluid property sensed by the sensor is transmitted to the remote location while the sensor senses the fluid property.

8. The system according to claim 6, wherein an indication of the fluid property sensed by the sensor is stored in the formation test assembly while the sensor senses the fluid property.

9. The system according to claim 6, wherein the sensor is positioned between a tester valve and a circulating valve of the formation test assembly.

10. The system according to claim 6, wherein the sensor is a fluid identification sensor.

11. The system according to claim 6, wherein the sensor is a solids sensor.

12. The system according to claim 6, wherein the sensor is a fluid density sensor.

13. The system according to claim 1, wherein the formation test assembly prevents the formation fluid from flowing to the earth's surface while the formation fluid flows through the formation test assembly.

14. The system according to claim 1, wherein the formation test assembly is interconnected in a tubular string.

15. The system according to claim 1, wherein the formation test assembly is interconnected in a coiled tubular string.

16. The system according to claim 1, wherein the formation test assembly is connected to an electrical conductor in the wellbore.

17. The system according to claim 1, wherein the fluid separation device is a plug received within a tubular string.

18. The system according to claim 17, further comprising a sampler attached to the plug.

19. The system according to claim 1, wherein an annulus is formed between the formation test assembly and the wellbore, and wherein the formation test assembly includes a packer isolating a first portion of the annulus in communication with the first zone from a second portion of the annulus in communication with the second zone.

20. The system according to claim 1, further comprising a line providing communication between the formation test assembly and the remote location.

21. The system according to claim 20, wherein the line is a fiber optic line.

22. The system according to claim 20, wherein the line transmits commands from the remote location, thereby remotely controlling operation of the formation test assembly.

23. The system according to claim 1, wherein the formation test assembly includes a flow control device selectively controlling flow of the formation fluid between the first chamber portion and at least one of the first and second zones.

24. The system according to claim 23, wherein the flow control device is electrically operated.

25. The system according to claim 23, wherein the flow control device is a valve selectively permitting and prevent flow therethrough.

26. The system according to claim 23, wherein the flow control device is a choke selectively regulating a rate of flow therethrough.

27. The system according to claim 1, wherein a pressure differential exists from the first zone to the first chamber portion, and the pressure differential inducing the formation fluid to flow from the first zone into the first chamber portion.

28. The system according to claim 1, wherein the fluid separation device displaces in a second direction opposite to the first direction when the formation fluid is flowed from the first chamber portion into the second zone.

29. The system according to claim 28, wherein the fluid separation device displaces in the second direction in response to pressure applied to the fluid separation device at the remote location.

30. A well testing system, comprising:

a formation test assembly positioned in a wellbore of the well, the formation test assembly including an internal chamber divided into first and second portions by a fluid separation device reciprocably received in the chamber, the fluid separation device, during reciprocation thereof within the chamber, being sealingly engaged with the chamber, the first chamber portion being in selective fluid communication with first and second zones intersected by the wellbore, the second chamber portion being in fluid communication with a remote location, and the formation test assembly including inlet and outlet openings in selective fluid communication with the first chamber portion, the inlet opening being in fluid communication with the first zone, and the outlet opening being in fluid communication with the second zone, and the first zone being isolated from the second zone in the wellbore when fluid is flowed into the first chamber portion from the first zone.

31. The system according to claim 30, wherein a first check valve is connected between the inlet opening and the first chamber portion.

32. The system according to claim 31, wherein a second check valve is connected between the first chamber portion and the outlet opening.

33. A well testing system, comprising:

a formation test assembly positioned in a wellbore of the well, the formation test assembly including an internal chamber divided into first and second portions by a fluid separation device reciprocably and sealingly received in the chamber, the first chamber portion being in selective fluid communication with first and second zones intersected by the welibore, the second chamber portion being in fluid communication with a remote location, a pressure differential existing from the first zone to the first chamber portion, the pressure differential inducing the formation fluid to flow from the first zone into the first chamber portion, and pressure applied to the second chamber portion inducing the formation fluid to flow from the first chamber portion into the second zone.

34. The system according to claim 33, wherein pressure is applied to the second chamber portion via a tubular string extending between the formation test assembly and the remote location.

* * * * *